United States Patent [19]

Yoshida

[11] 4,192,134

[45] Mar. 11, 1980

[54] ELECTRONIC TIMEPIECE CORRECTION DEVICE

[75] Inventor: Makoto Yoshida, Tokorozawa, Japan

[73] Assignee: Citizen Watch Company Limited, Japan

[21] Appl. No.: 845,559

[22] Filed: Oct. 26, 1977

[30] Foreign Application Priority Data

Oct. 28, 1976 [JP] Japan ..... 51-129921

[51] Int. Cl.[2] ..... G04B 27/00; G04C 3/00

[52] U.S. Cl. ..... 368/80; 368/188; 368/85

[58] Field of Search ..... 58/4 A, 23 R, 23 D, 58/50 R, 85.5; 307/22 R; 328/44, 48; 310/40 MM, 49, 163; 318/138, 696; 235/92 T; 364/569

[56] References Cited

U.S. PATENT DOCUMENTS

| | | | |
|---|---|---|---|
| 3,156,836 | 11/1964 | Winther | 310/40 MM |
| 3,540,207 | 11/1970 | Keeler | 58/23 R |
| 3,733,803 | 5/1973 | Hiraga et al. | 58/23 R |
| 3,852,952 | 12/1974 | Vitto et al. | 58/23 R |
| 4,055,785 | 10/1977 | Nakajima et al. | 318/138 |
| 4,066,947 | 1/1978 | Nakajima et al. | 318/696 |
| 4,086,755 | 5/1978 | Ueda | 58/85.5 |
| 4,095,405 | 6/1978 | Tanaka | 58/4 A |

*Primary Examiner*—Vit N. Miska

[57] ABSTRACT

An electronic timepiece equipped with an oscillator for producing a time base, a freuqency divider and time display means drive in response to output signals supplied by the frequency divider, which timepiece includes correction system characterized in that a single switch is provided for rapidly correcting the time display means, wherein time corrections are alternatively accomplished in an advancing and retarding direction each time the switch is depressed.

6 Claims, 4 Drawing Figures

FORWARD DRIVE CIRCUIT
REVERSE DRIVE CIRCUIT
FREQUENCY DIVIDER
OSC.
DIFF. CIRCUIT
ANTI-CHATTER CIRCUIT
1/60Hz
8Hz
64Hz
"0" "1"

ELECTRONIC TIMEPIECE CORRECTION DEVICE

This invention relates to a time correction system for the time display of an electronic timepiece.

Quartz timepieces with an analog-type display adopt a crystal controlled oscillator as a time base and display time by means of electronic circuitry in which an analog display device is driven by means of a stepping motor. In order to effect a time correction, such electronic timepieces were conventionally equipped with a hand setting mechanism for rotating the hands of the time display. The manipulation of a correction control member such as a crown enabled the hands to be automatically rotated through the intermediary of the hand setting mechanism while a wheel train for driving the hands in response to the stepping motor was caused to slip. However, in quartz timepieces which are characterized by their high precision and extended life, the utilization of such a hand setting mechanism and slip mechanism are unwise since these timepieces seldom need to be corrected. Such mechanisms add to the size of timepieces and raise costs due to their number and the time required to assemble them.

An object of the present invention is therefore to obviate the aforementioned disadvantages and provide, through simplifying the time correction mechanism, an attractive, inexpensive electronic timepiece in which accurate time corrections can be made through a simple operation.

Another object of the present invention is to provide an electronic timepiece having a correction system by which two different correction operations can be alternatively accomplished with the use of a single correction switch.

Still another object of the present invention is to provide an electronic timepiece having a correction system in which a single correction switch is provided for rapidly correcting a time display, wherein the display is alternatively corrected in the forward and reverse directions each time the single switch is actuated.

A further object of the present invention is to provide an electronic timepiece having a correction system which makes it possible to correct a time display within the shortest period in an easy manner.

A still further object of the present invention is to provide an electronic timepiece having a correction system which is simple in circuit arrangement and highly reliable in operation.

These and other objects, features and advantages of the present invention will become more apparent from the foregoing description when taken in conjunction with the accompanying drawings, in which.

Before entering into a detailed description of the present invention it should be noted that while the terms "forward" and "reverse" are used in the description these terms represent "advancing" and "retarding", respectively. Thus, in an analog timepiece, the "forward" direction means the "clockwise" direction and the "reverse" direction means the "counter-clockwise" direction. Similarly, in a digital timepiece, the "forward" direction means the "upcounting" operation of a time counter and the "reverse" direction means a "downcounting" operation of the time counter.

Figures 1, 2:
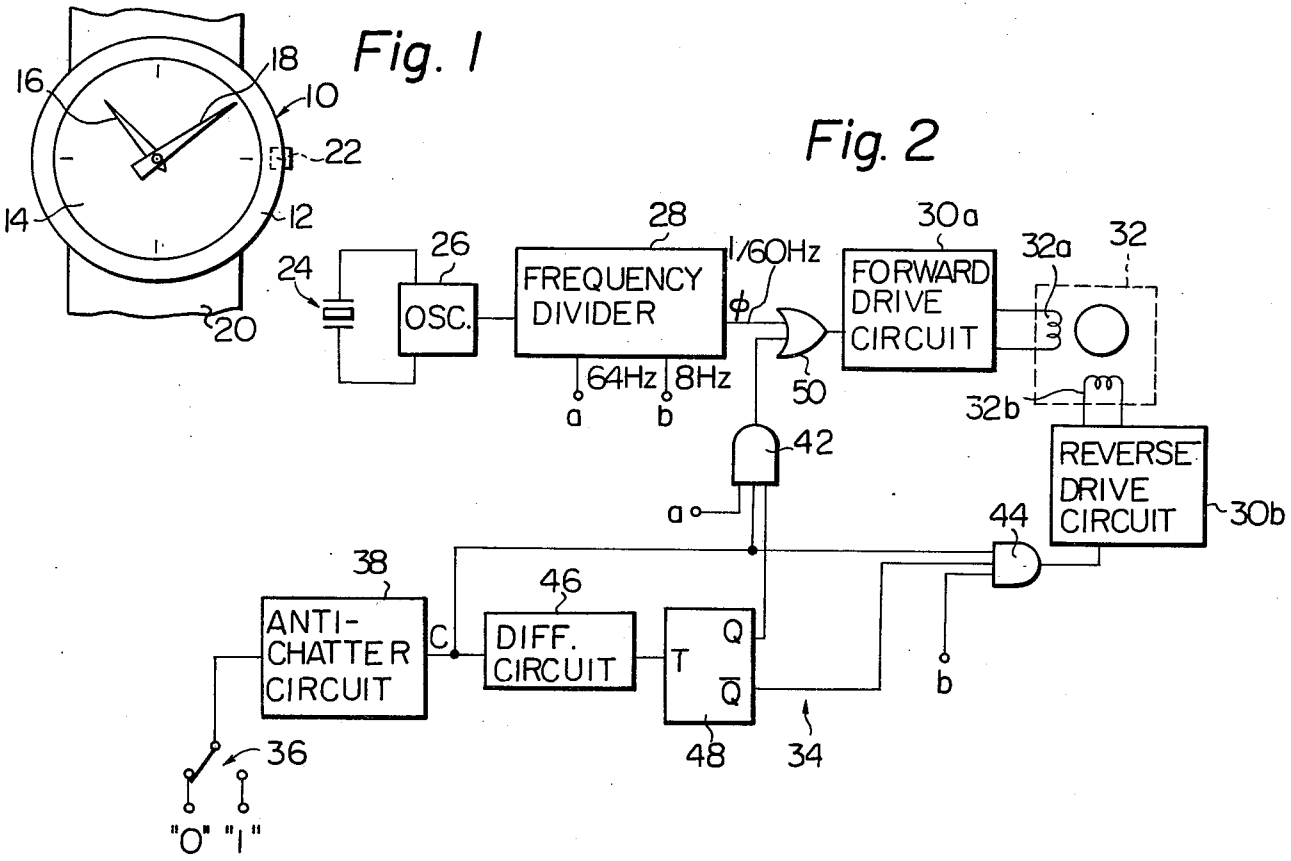
FIG. 1 is an external view of a preferred embodiment of a 2-hand analog timepiece according to the present invention.
FIG. 2 is a block diagram of the timepiece shown in FIG. 1.

FIG. 1 is a plan view showing the external appearance of a 2-hand analog quartz timepiece in accordance with the invention. The timepiece 10 includes a case 12, a dial 14, an hours hand 16, a minutes hand 18, a band 20 and a correction button 22 located in a recessed portion of case 12. A time correction is performed by using a pen or other pointed object to depress the correction button 22.

FIG. 2 is a block wiring diagram of a 1st preferred embodiment of the invention.

In FIG. 2, the electronic timepiece comprises a quartz crystal 24, a frequency standard 26 controlled by the quartz crystal to provide a relatively high frequency signal, a frequency divider 28 which divides down the relatively high frequency signal to provide a low frequency time unit signal $\phi$, a forward drive circuit 30*a*, a reverse drive circuit 30*b*, and a stepping motor 32 including a forward drive coil 32*a* and a reverse drive coil 32*b* to actuate the time indicating means 16 and 18. A time correction system includes a single correction switch 36 normally held at a "0" logic level and adapted to be held at a "1" logic level by the actuation of the button 22. The correction switch 36 is coupled to an anti-chatter circuit 38, to which correction gates 42 and 44 and a differentiation circuit 46 are also connected. Connected to an output of the differentiation circuit 46 is a correction mode change-over circuit 48 including a toggle effect and providing output signals alternately at first and second output terminals each time the correction switch 36 is actuated. In this preferred embodiment, the change-over circuit 48 is shown as comprising a toggle-type flip-flop having its input terminal T connected to the output of the differentiation circuit 46, Q output connected to a second input of the first correction gate 42, and $\overline{Q}$ output connected to a second input of the second correction gate 44. The first correction gate 42 has a third input connected to the frequency divider 28 to receive a train of correction pulses at a frequency of 64 Hz. Likewise, a third input of the second correction gate 44 is connected to the frequency divider 28 to receive a second train of correction pulses at a frequency of 8 Hz of the first train of correction pulses. An output of the first correction gate 42 is coupled through an OR gate 50 to the forward drive circuit 30*a*, and an output of the second correction gate 44 is coupled to the reverse drive circuit 30*b*.

In operation, a relatively high frequency signal produced by oscillator 26 is divided down by divider 28 and appears as an output signal $\phi$ which is applied to stepping motor forward drive circuit 30*a* across OR gate 50. Since a drive signal arrives at forward coil 32*a*, stepping motor 32 rotates in the forward direction and advances the hands of the timepiece. A 1/60 Hz signal is employed in a case where minute hand 18 is advanced once every minute, and a 1/20 Hz signal is utilized in a case where the minute hand is advanced once every 20 seconds. Since correction switch 36 is normally held at a "0" logic level, no correction signal C appears. Accordingly, AND gates 42, 44 are closed and there is no output. If correction button 36 is now depressed so as to change over correction switch 36 to a "1" logic level, a correction signal C appears after passing anti-chatter circuit 38 and is applied to AND gates 42, 44 which are thus brought to a stand-by condition. Correction signal C is also differentiated by differentiation circuit 46 so that a positive-going pulse is applied to terminal T of toggle-type flip-flop 48. Upon the arrival of the pulse, flip-flop 48 experiences a reversal in state. For example, if it is assumed that terminal Q ia at a "0" logic level and terminal $\bar{Q}$ at a "1" logic level prior to the arrival of the pulse, the logic levels will reverse when the pulse arrives. Accordingly, with terminals Q and $\bar{Q}$ now at respective logic levels of "1" and "0", AND gate 42 opens so that the 64 Hz signal applied to terminal a is passed by AND gate 42 and coupled to stepping motor forward drive circuit 30*a* across OR gate 50. Consequently, stepping motor 32 rotates in the forward direction and causes the minutes hand to rapidly advance at a rate of 64 steps over 1 second of time. Hours hand 16 is also rapidly advanced through the movement of the minutes hand.

Advancing the minutes hand at this high rate of speed makes it difficult to accurately stop the minutes hand at the correct position. Releasing the correction button 22 after the minutes hand has arrived at the correct position will result in the minutes hand coming to a stop slightly beyond the correct position. Thereafter, if correction button 22 is depressed again, correction switch 36 is once again switched over to a "1" logic level, correction signal C appears, and the positive going pulse is applied to terminal T of flip-flop 48 so that terminals Q and $\bar{Q}$ are returned to respective logic levels of "0" and "1". Accordingly, AND gate 42 closes so that the 64 Hz signal at terminal a is not passed. On the other hand, AND gate 44 opens so that the 8 Hz signal at terminal b is applied to the stepping motor reverse drive circuit 30*b* thereby to rotate the stepping motor 32 in the reverse direction. Thus, minutes hand 18 is turned back in time at a comparatively slow rate of 8 steps per second; hence, an accurate time correction can be readily accomplished by releasing correction button 22 when the minutes hand has reached the correct position. If the minutes hand comes to rest short of the correct position or widely separated from it, correction button 22 is released once and then depressed again when minutes hand 18 begins to turn back in time at the rate of 8 steps per second. This causes the output of flip-flop 48 to reverse and allows the minutes hand to be advanced at the high speed of 64 steps per second.

Thus, according to the 1st embodiment of the invention, a forward correction at a rate of 64 steps per second and a reverse correction at a rate of 8 steps per second are alternately available each time the correction switch 36 is manipulated. Moreover, although not specifically described, it is possible to suitably select the speeds at which the forward and reverse corrections are performed.

Figure 3:
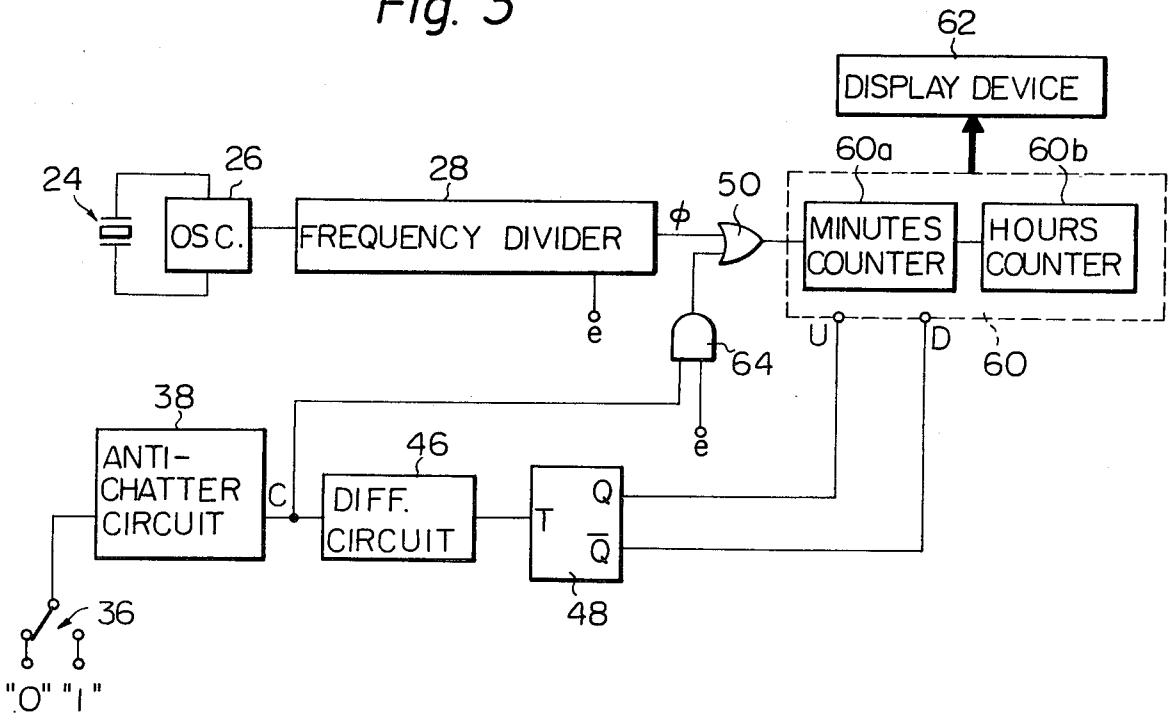
FIG. 3 is a block diagram of another preferred embodiment of an electronic timepiece according to the present invention.

FIG. 3 is a block wiring diagram of a 2nd embodiment of the invention as applied to an electronic timepiece with a digital display. Blocks identical to those of FIG. 2 bear the same reference numerals and do not require explanation.

Reference numeral 60 denotes a time-keeping circuit having a minutes counter 60*a* and hours counter 60*b*. Reference numeral 62 designates electro-optical display means composed of liquid crystals, LEDs or the like. The time-keeping circuit 60 is normally driven by an output signal $\phi$, such as a 1/60 Hz signal supplied by the frequency divider 28, and minutes and hours are digitally displayed by the display means 62.

In order to perform a time correction in a timepiece having the above-described construction, the time-keeping circuit 60 is provided with a count-up terminal U and count-down terminal D connected respectively to terminals Q, $\bar{Q}$ of flip-flop 48. Reference numeral 64 denotes an AND gate having a terminal e which is supplied with a 4 Hz signal. When performing a minutes correction, the minutes counter 60*a* is selected by digit selection means (not shown). Thereafter, depressing correction button 22 changes over correction switch 36 to a "1" logic level, whereupon the correction signal C is applied to AND gate 64 causing it to open and thus pass the 4 Hz signal at terminal e. After passing OR gate 50, the 4 Hz signal drives the minutes counter 60*a*. At this time, differentiation circuit 46 applies the positive-going portion of the correction signal to terminal T of flip-flop 48; hence, if it is assumed that the logic levels at terminals Q, $\bar{Q}$ of flip-flop 48 are respectively "0" and "1" immediately prior to the arrival of the correction signal, a reversal will take place with "1" appearing at terminal Q and "0" appearing at terminal $\bar{Q}$. A signal will thus be delivered to count-up terminal U of minutes counter 60*a*, which, owing to the signal at terminal e, will count up at a rate of 4 counts per second, thereby rapidly advancing the minutes display on display means 62. The correction button 22 is released when the desired time is displayed on the display means. In a case where the minutes display can be corrected faster by reversing the count, releasing the correction button once and then depressing it again causes flip-flop 48 to reverse state due to the positive-going portion of the correction signal. Terminals Q, $\bar{Q}$ thus attain respective "0", "1" logic levels so that a signal is delivered to count-down terminal D of minutes counter 60*a* which will accordingly count down at a rate of 4 counts per second, thereby causing the digits on the display device to "back-up" at a rapid rate.

Although not described here, an hours correction can be accomplished in the same manner after the hours counter 60*b* has been selected.

In accordance with the 2nd embodiment, therefore, a digital display is corrected by a count-up operation or count-down operation, both of which are alternately applied each time the correction button is depressed. It should also be understood that the correction speed may be optionally chosen. Moreover, if the invention is applied to a digital alarm circuit instead of the time-keeping circuit, it is possible to selectively correct the alarm timing by way of the correction button.

Figure 4:
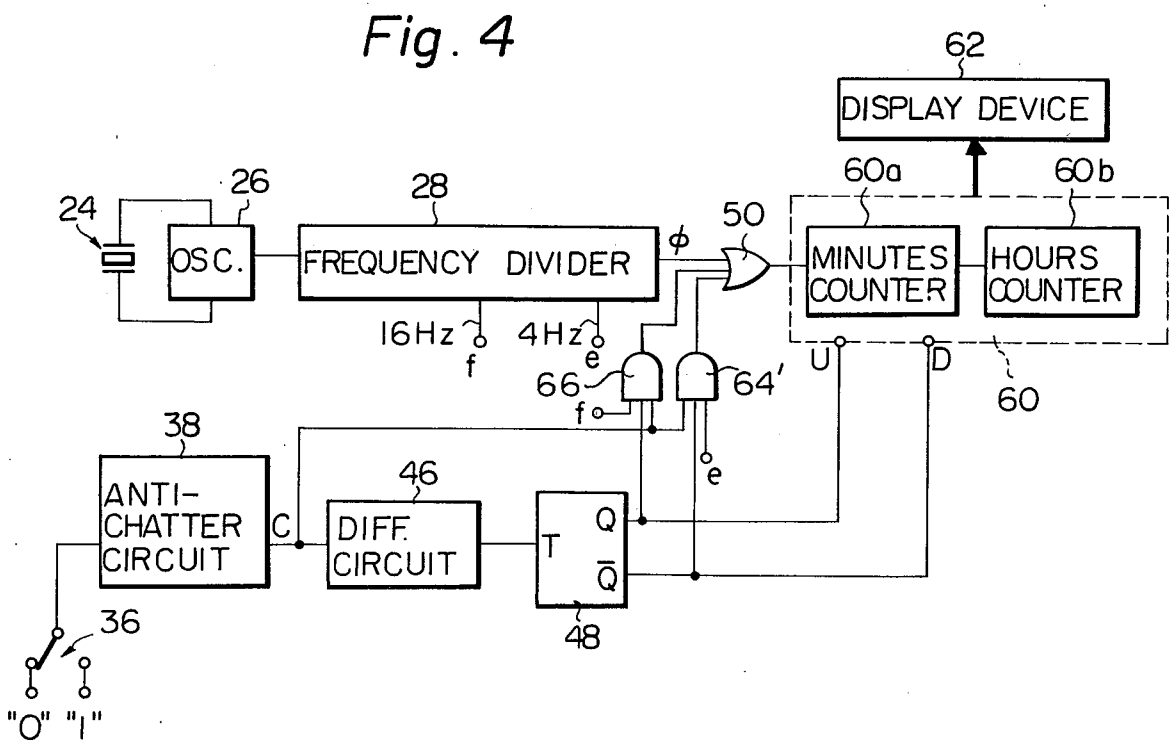
FIG. 4 is a block diagram of a modified form of the timepiece shown in FIG. 3.

FIG. 4 shows a modified form of the electronic timepiece shown in FIG. 3, with like parts bearing the same reference numerals as those used in FIG. 3. The embodiment of FIG. 4 is similar to that of FIG. 3 except that an AND gate 64' is also coupled to the $\bar{Q}$ output of the flip-flop 48 and an AND gate 66 has first input coupled to the output of the anti-chatter circuit 38, a second input coupled to the $\bar{Q}$ output of the flip-flop 48 and a third input coupled to the frequency divider 28 to receive a train of pulses at a frequency of 16 Hz.

If correction button 22 is depressed with the circuit in the same initial state as that described in the 2nd embodiment prior to beginning the correction operation, correction switch 36 is changed over to a "1" logic level, a correction signal C appears and is applied to AND gates 66, 64' which are thus brought to a stand-by condition. A positive-going pulse is applied to terminal T of flip-flop 48 by virtue of the differentiation circuit 48, whereby the terminal Q of the flip-flop 48 changes from a "0" to a "1" logic level while the terminal $\overline{Q}$ changes from a "1" to a "0" logic level. Accordingly, only AND gate 66 opens so that the 16 Hz correction signal at terminal f is passed through the OR gate 50. If, in this case, the minutes counter 60*a* is selected by digit selection means (not shown), a signal will be applied to count-up terminal U of minutes counter 60*a* which will count up at a rate of 16 counts per second, thereby rapidly advancing the minutes display on display means 62. The correction button 22 is released when the desired time is displayed on the display means. In a case where the minutes display can be corrected faster by reversing the count, releasing the correction button once and then depressing it again causes flip-flop 48 to reverse state due to the positive-going portion of the correction signal. Terminals Q and $\overline{Q}$ therefore attain the "0" and "1" logic levels respectively, so that the 4 Hz signal from terminal e is applied through AND gate 64 and OR gate 50 to counter 60, and a "1" level signal is applied to count-down terminal D of counter 60. Minutes counter 60*a* therefore begins to count down at a rate of 4 counts per second, so that time correction in the retarding direction is accomplished in a relatively gradual manner, as compared with correction in the advancing direction.

The method of time correction in accordance with the invention thus permits a time correction to be performed by only a single correction switch and simple structure composed of a small number of circuit components. Hence, correction mechanisms such as a crown, hand-setting means and a slip mechanism which were in stalled in conventional analog type timepieces can now be eliminated, an advantage which allows improvements in design due to reductions in timepiece size, and reductions in cost due to fewer parts and assembly steps. Furthermore, the invention may also be applied to digital-type timepieces due to the fact that time corrections can be rapidly and accurately performed by a simple operation. The invention is particularly effective when applied to a timepiece with a digital alarm since alarm settings are frequently made.

Finally, although the system of time correction according to the invention may be applied to an electronic timepiece having three hands, i.e., an hour, minute and second hand, it is particularly well suited to electronic timepieces having only a minute and second hand in which the maximum number of steps is small, as is the case in the embodiments described herein.

While the present invention has been shown and described with reference to particular embodiments by way of example, it should be noted that various other changes or modifications may be made without departing from the scope of the present invention.

What is claimed is:

1. A time correction system for an electronic timepiece having a frequency standard, a frequency divider providing a low frequency time unit signal, a first train of output pulses and a second train of output pulses, the frequencies of said first and second trains of output pulses being higher than the frequency of said time unit signal and different from one another, and a display device providing a display of time information in response to the time unit signal, said time correction system comprising:

a single push-button type correction switch responsive to actuation for producing a correction signal;

circuit means having a toggle effect and including first and second outputs at which first and second output signals alternately appear in response to each occurrence of said correction signal; and means for correcting time information displayed by said display device in an advancing direction in response to said first train of output pulses and said first output signal, and for correcting the time information in a retarding direction in response to said second train of output pulses and said second output signal.

2. A time correction system according to claim 1, in which said electronic timepiece also has a timekeeping circuit composed of counter means including a count-up terminal and a count-down terminal and operative to perform a count-up operation and a count-down operation, said count-up terminal and said count-down terminal being connected to said first and second outputs of said circuit means, respectively, and in which said display means comprises an electro-optical display device for displaying the contents of said counter means in digital form, and furthermore in which said correction means comprises a first gate responsive to said first output signal from said circuit means to pass said first train of output pulses to said counter circuit and a second gate responsive to said second output signal from said circuit means to pass said second train of output pulses to said counter circuit.

3. A time correction system according to claim 1, in which said circuit means comprises a toggle-type flip-flop.

4. A time correction system according to claim 3, in which said electronic timepiece also has a stepping motor and said display device comprises time indicating hands driven by said stepping motor, and in which said correction means comprises a forward drive circuit connected to said first output of said circuit means, a reverse drive circuit connected to said second output of said circuit means, a first gate responsive to said first output signal from said circuit means to pass said train of output pulses to said forward drive circuit to cause said stepping motor to drive said time indicating hands in said advancing direction and a second gate responsive to said second output signal from said circuit means to pass said train of output pulses to said reverse drive circuit to cause said stepping motor to drive said time indicating hands in said retarding direction.

5. An electronic timepiece having time indicating hands to display time comprising:

a frequency standard providing a relatively high frequency signal;

a frequency divider providing a low frequency time unit signal in response to said relatively high frequency signal and first and second trains of output pulses, said first and second trains of output pulses being both of higher frequency than said time unit signal and being different in frequency from one another;

a stepping motor for actuating said time indicating hands;

a forward drive circuit connected to said frequency divider for normally energizing said stepping motor in response to said time unit signal to cause said stepping motor to actuate said time indicating hands in an advancing direction in a normal mode;

a reverse drive circuit connected to said stepping motor to cause said stepping motor to actuate said time indicating hands in a retarding direction;

a single push-button type correction switch being responsive to actuation for producing a correction signal;

a differentiation circuit for providing a differentiation pulse in response to each occurrence of said correction signal;

toggle-type flip-flop means including first and second outputs and responsive to successive occurrences of said differentiation pulse for alternately producing first and second output signals on said first and second outputs respectively;

first gate means responsive to said correction signal and said first output signal to pass said first train of output pulse to said forward drive circuit, whereby said stepping motor is driven by said first train of output pulses to correct said time indication hands in an advancing direction; and second gate means responsive to said correction signal and said second output signal to pass said second train of output pulses to said reverse drive circuit to cause said stepping motor to correct said time indicating hands in a regarding direction;

said toggle-type flip-flop means alternatively providing said first and second output signals upon successive actuations of said single correction switch; whereby said first and second trains of output pulses are alternately applied to said forward drive circuit and said reverse drive circuit to alternately correct said time indicating hands in said advancing and retarding directions.

6. An electronic timepiece having electro-optical display means to provide a display of time information, comprising:

a frequency standard providing a relative high frequency signal;

a frequency divider providing a low frequency time unit signal in response to said relatively high frequency signal, and first and second trains of output pulses, said first and second trains of output pulses being both of higher frequency than said time unit signal and being different in frequency from one another;

a timekeeping circuit composed of counter means including a count-up terminal and a count-down terminal and operative to perform a count-up operation and a count-down operation;

a single push-button type correction switch being responsive to actuation for producing a correction signal;

a differentiation circuit for providing a differentiation pulse in response to each occurrence of said correction signal;

toggle-type flip-flop means including first and second outputs and responsive to successive occurrences of said differentiation pulse for alternately producing first and second output signals on said first and second outputs respectively;

first gate means responsive to said correction signal and said first output signal to pass said first train of output pulses to said counter means; and second gate means responsive to said correction signal and said second output signal to pass said second train of output pulses to said counter means;

said toggle-type flip-flop means alternately providing said first and second output signals upon successive actuations of said correction switch, whereby said first and second trains of output pulses are alternately applied to said counter means to alternately correct said display means in advancing and retarding directions.

* * * * *